US006897815B2

(12) United States Patent
Goto et al.

(10) Patent No.: US 6,897,815 B2
(45) Date of Patent: May 24, 2005

(54) SURFACE-MOUNT TYPE ANTENNAS AND MOBILE COMMUNICATION TERMINALS USING THE SAME

(75) Inventors: Kazuhide Goto, Miyazaki (JP); Yoshio Onaka, Miyazaki (JP); Makoto Yoshinomoto, Miyazaki (JP); Hiromi Sakita, Miyazaki (JP); Katsumi Sasaki, Miyazaki (JP); Kengo Shiiba, Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/403,046

(22) Filed: Apr. 1, 2003

(65) Prior Publication Data

US 2003/0189520 A1 Oct. 9, 2003

Related U.S. Application Data

(62) Division of application No. 09/960,379, filed on Sep. 24, 2001, now Pat. No. 6,559,802.

(30) Foreign Application Priority Data

Apr. 25, 2001 (JP) ..... 2001-127455

(51) Int. Cl.[7] ..... H01Q 1/24
(52) U.S. Cl. ..... 343/702; 455/404.2
(58) Field of Search ..... 455/404.1, 404.2, 455/82; 343/700 MS, 702

(56) References Cited

U.S. PATENT DOCUMENTS

| | | | | |
|---|---|---|---|---|
| 5,969,690 | A | 10/1999 | Tsuru et al. | 343/700 MS |
| 6,653,978 | B2 * | 11/2003 | Lahti | 343/702 |

FOREIGN PATENT DOCUMENTS

| | | |
|---|---|---|
| JP | 7-221537 | 8/1995 |
| JP | 7-226616 | 8/1995 |
| JP | 7-235825 | 9/1995 |
| JP | 9-214226 | 8/1997 |
| JP | 11-74721 | 3/1999 |
| JP | 11-112221 | 4/1999 |

* cited by examiner

*Primary Examiner*—Michael C. Wimer
(74) *Attorney, Agent, or Firm*—Wenderoth, Lind & Ponack, L.L.P.

(57) ABSTRACT

A surface-mount type antenna and a communication terminal using the same. A radiator electrode is provided on a first principal face of a substrate. A ground electrode is provided on the second principal face of the substrate. A first feeder electrode has at least a portion thereof provided on a side face and on the second principal face of the substrate. A second feeder electrode is provided on an inner wall face of a hole formed parallel to the first and second principal faces. The first feeder electrode and the ground electrode are kept in a non-contact state. The first feeder electrode and the second feeder electrode are in electrical contact. A mobile communication terminal using the surface-mount type antenna is small in size, exhibits small variations in characteristics, and provides high productivity and reliability.

18 Claims, 15 Drawing Sheets

SURFACE-MOUNT TYPE ANTENNAS AND MOBILE COMMUNICATION TERMINALS USING THE SAME

This application is a divisional application of application Ser. No. 09/960,379, filed Sep. 24, 2001 now U.S. Pat. No. 6,559,802.

FIELD OF THE INVENTION

The present invention relates to a surface-mount type antenna for use in a global positioning system, more particularly to a surface-mount type antenna mounted on a portable remote terminal, and to a mobile communication terminal using the same.

BACKGROUND OF THE INVENTION

A system having a global positioning system mounted on a portable remote terminal for transmitting information of the present position of the terminal to a specific party on the other end of the connection is being put to practical use. For example, when a carrier of the portable remote terminal meets an emergency (such as a traffic accident), the person can transmit information of his or her present position to a specific place (such as a rescue center) so as to take a necessary measure without delay.

As antennas used on such a portable remote terminal, surface-mount type antennas have frequently been used because of the terminal being limited in size. For example, a surface-mount type antenna disclosed in Japanese Patent Non-examined Publication No. H7-221537 has a configuration of a radiator electrode provided by a through hole formed parallel to a principal face of a dielectric substrate and of a through hole formed in the direction of the thickness of the dielectric substrate for electrically connecting a radiator electrode with a feeder electrode. In another example, Japanese Patent Non-examined Publication No. H7-235825 discloses a radiator electrode and a coplanar type feeder line provided on each of the principal faces of a dielectric substrate, wherein the radiator electrode and feeder line are connected by a through hole.

In both of the antennas described above, since high precision is required of the size of the through hole and, further, the input impedance of the antenna is directly affected by a connection made at the through hole, great variations in characteristics were produced between products.

In the case of a surface-mount type antenna disclosed in Japanese Patent Non-examined Publication No. H9-214226, an attempt was made to miniaturize the antenna by embedding the feeder electrode in the substrate. However, productivity was poor because this process required cementing substrates together and, sometimes, great variations in characteristics were produced. In addition, because of a difference of thermal expansion coefficient between the substrate and the feeder electrode, cracks were produced, or stress was accumulated, in the substrate, and, sometimes, variations in characteristics were produced.

Further, an antenna disclosed in Japanese Patent Non-examined Publication No. H11-112221 is designed to achieve miniaturization by such a layout that a feeder electrode is surrounded by a radiator electrode. In this case, a minute distance was preset between the feeder electrode and the radiator electrode early in the designing stage to provide the antenna with required impedance matching.

Accordingly, this type of antenna lacks adjustment means and hence variations in characteristics between products sometimes became considerably great, depending on the manner of fabrication.

Further, in a surface-mount type antenna disclosed in Japanese Patent Non-examined Publication No. H11-74721, it is arranged such that the radiator electrode and the ground electrode are provided on the same principal face, whereas no particular design is made to decrease occupied areas by the two electrodes. Accordingly, the dielectric substrate becomes large in size and, therefore, miniaturization of the antenna has been difficult to achieve.

There has been such a technical problem with these prior art surface-mount type antennas that miniaturization of the product, decreased variations in characteristics between products, and increased productivity and enhanced reliability on the product cannot be attained at the same time.

SUMMARY OF THE INVENTION

In view of the problem described above, it is an object of the present invention to provide a surface-mount type antenna being small in size, producing small variations in characteristics between products, and being excellent in productivity and reliability, and, in addition, to provide a communication terminal using the same.

A surface-mount type antenna to be mounted on a printed circuit board of the present invention comprises: a substrate; a radiator electrode provided on a first principal face of the substrate; a ground electrode provided on its second principal face; a first feeder electrode having at least a portion thereof provided on the second principal face and on a side face of the substrate; and a second feeder electrode provided on an inner wall face of a hole formed in the side face, or, more particularly, formed on the first feeder electrode and located between the radiator electrode and the ground electrode.

Further, the first feeder electrode and the ground electrode are kept in a non-contact state and the first feeder electrode and the second feeder electrode are in electrical contact.

Instead of providing the second feeder electrode within a hole, it is possible to use, as the second feeder electrode, a feeder electrode provided on a stepped face of a stepped portion formed by cutting step-wise a portion of the side face on the side of the second principal face and close to the first feeder electrode. In this case, it may also be practiced to provide additionally a second ground electrode on a stepped face of a stepped portion formed by cutting step-wise a portion on the side of the second principal face of each of four side faces of the substrate and have this electrode electrically connected with the ground electrode provided on the second principal face.

As another type of second feeder electrode, a feeder electrode provided on an inner wall face of a groove formed in the second principal face can be used and, thereby, ease of fabrication can be obtained. As a further type of second feeder electrode, such a feeder electrode can also be used that is provided on an inner wall of a groove formed at a portion of the side face, on which the first feeder electrode is provided, parallel to the first and second principal faces.

By virtue of the above described structure, the surface-mount type antennas according to the present invention and communication terminals using the antenna can achieve miniaturization, reduction of variations in characteristics between products, and increase in productivity of and reliability on the products.

DESCRIPTION OF THE PREFERRED EMBODIMENTS

Figure 1A:
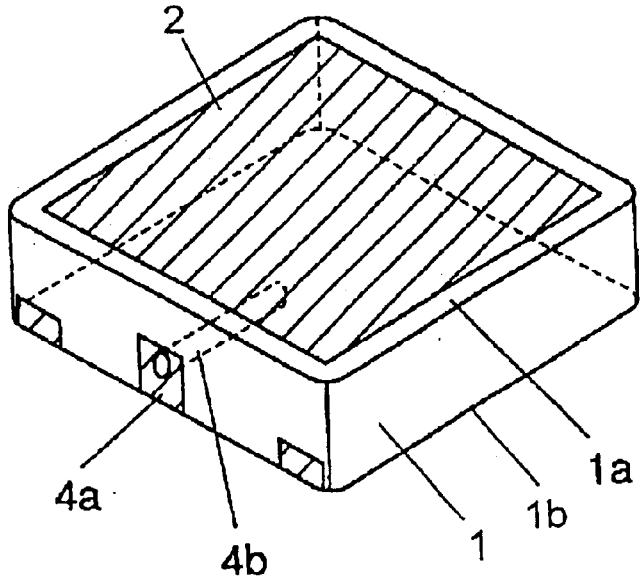
FIG. 1 is a perspective view of a surface-mount type antenna according to exemplary embodiment 1 of the invention.

Each of exemplary embodiments of the present invention will be described below with reference to their respective drawings.

<<Exemplary Embodiment 1>>

FIGS. 1, 2, 3, and 4 are a perspective view, a top appearance view, a plan view, and a side view, respectively, of a surface-mount type antenna according to exemplary embodiment 1 of the present invention.

Main components of the present exemplary embodiment and electric characteristics thereof will be enumerated below:

1. Substrate (a) $\in_r$

In FIGS. 1, 2, 3, and 4, a substrate 1 is made of a dielectric material whose relative dielectric constant $\in_r$ is preferably not smaller than 4 and not greater than 150 (more preferably, not smaller than 18 and not greater than 130). When relative dielectric constant $\in_r$ is smaller than 4, the size of substrate 1 becomes too large and miniaturization of the antenna becomes unattainable. When relative dielectric constant $\in_r$ is greater than 150, the operating frequency range of the antenna becomes too narrow. Then, the operating frequency deviates from a predetermined frequency range if there is produced a small difference in chemical composition or a small chip on the substrate. Hence, such a disadvantage arises that not only desired characteristics cannot be obtained but also variations in characteristics become great. Within a range of relative dielectric constant $\in_r$ between 4 and 12, a resin substrate having a dielectric loss tangent of 0.005 or below and showing a small decrease in Q-factor is preferably used, and, within a range between 6 and 150, a ceramic substrate having, likewise, a dielectric tangent of 0.005 or below and showing a small decrease in Q-factor is preferably used.

(b) Material

As concrete examples of component materials of substrate 1, glass-impregnated fluororesin, glass-impregnated thermosetting poly-phenylene-oxide (PPO) resin, bismaleimide-triazine (BT) resin, powdered-ceramics impregnated poly-tetra-fluoro-ethylene (PTFE) laminated substrate, resin group substrate of ceramic/whisker or the like, and ceramic substrate of forsterite group, alumina group, magnesium titanate group, calcium titanate group, zirconia-tin-titan group, barium titanate group, and lead-calcium-titan group are used. Especially when weather resistance, mechanical strength, and economy of the substrate are taken into consideration, it is preferred that ceramic be used. In this case, in order to improve flexural strength and the like, the sintering density is preferred to be 92% or above (more preferably, 95% or above). When the sintering density is below 92%, such disadvantages as decrease in the Q-factor and relative dielectric constant $\in_r$ arise.

(c) Shape

Substrate 1 may be formed in a square plate shape, a polygonal plate shape (having a triangular, rectangular, pentagonal, or such a cross-section), and a circular plate shape. When it is formed in a polygonal plate shape, it is preferred to be formed in a regular polygonal shape for ease of mounting and for obtaining excellent characteristics.

Surface roughness of substrate 1 is preferred to be 50 $\mu$m or below (more preferably, 10 $\mu$m or below and still more preferably 5 $\mu$m or below). When the surface roughness is larger than 50 $\mu$m, the conductor loss of the electrode is increased and the absolute antenna gain is lowered and, further, fluctuation of the effective relative dielectric constant occurs. This, sometimes, produces a drift of the antenna operating frequency and lowers the antenna gain in a specified frequency range.

In the present embodiment, the thickness of substrate 1 has been made uniform (the thickness at the center portion has been made virtually equal to the thickness at the end portion) to ensure uniform characteristics or stabilized characteristics. However, depending on the operating conditions or the kind of terminals on which the antenna is mounted, the thickness of substrate 1 in a specific range may be made different from that in other portions. For example, a plurality of recessed portions or stepped portions may be provided in substrate 1 or the thickness of substrate 1 at one end may be made different from that at the other end.

Figure 1B:
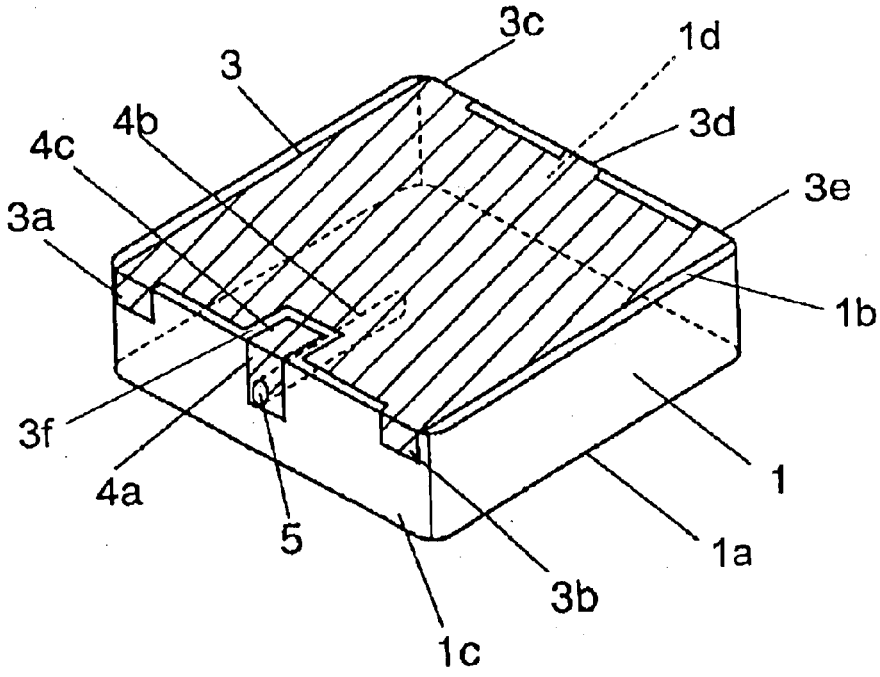
Figure 2:
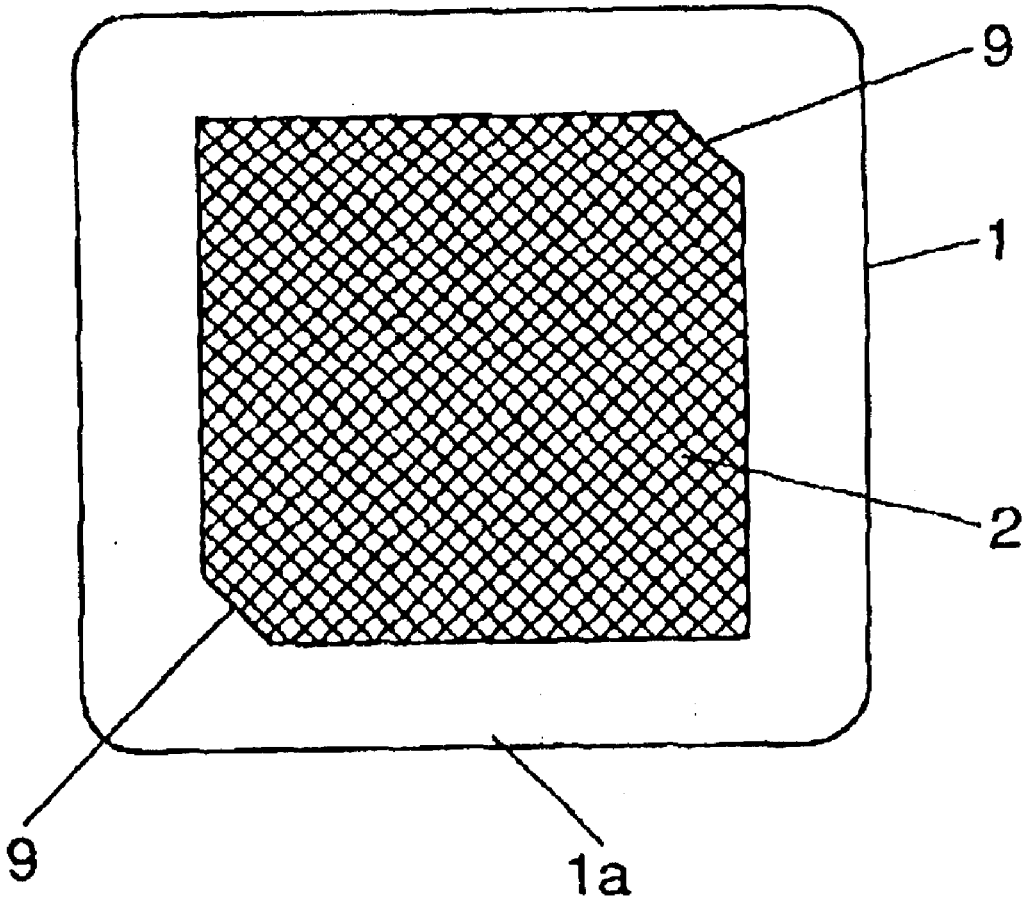
FIG. 2 is a top appearance view of the surface-mount type antenna according to exemplary embodiment 1 of the invention.

Further by providing chamfering and tapering at corner portions of substrate 1 as shown in FIG. 1, antenna characteristics are prevented from changing due to a large chip produced at corner portion 1*c* of substrate 1.

From the viewpoint of productivity, provision of C chamfering or R chamfering is preferable because it ensures reliable processing at the corner portion. At this time, by making corner processing by C chamfering or R chamfering 0.1 mm or larger (preferably, 0.2 mm or larger), chipping off of the corner portion of substrate 1 hardly occurs when substrate 1 is subjected to a certain shock. Even if it is subjected to a large shock, only a small chip may be produced. Thus, the transmitting and receiving characteristics can be prevented from being affected. While such a chamfering or tapering process is required to be carried out regardless of the material of the substrate, it is particularly effective when a ceramic material liable to produce a chip is used.

Incidentally, instead of carrying out such corner processing as described above, an organic resin or the like may be provided at the corner portion to prevent production of a large chip at the corner portion.

By talking such a measure to prevent production of a chip as described above, it is made possible to suppress occurrence of a failure in the fabrication process accompanied by deterioration in the antenna characteristics on account of a produced chip. Hence, productivity and yield of antennas can be improved.

(d) Size

When breadth of an antenna denoted by $L_1$ (cm), length by $L_2$ (cm), and thickness by $L_3$ (cm) satisfy the following conditions, the operating frequency of the antenna is optimized and the external size thereof is minimized and, hence, antennas can be supplied stably and the gain and bandwidth can be secured properly:

$$2\lambda_0(7\in_r^{1/2})\leqq L_1 2\lambda_0/(2\in_r^{1/2}),$$
$$2\lambda_0(7\in_r^{1/2})\leqq L_2 2\lambda_0/(2\in_r^{1/2}),$$
$$\lambda_0(30\in_r^{1/2})\leqq L_3\lambda_0/(2\in_r^{1/2}),$$

where $\lambda_0$ represents the free space wavelength (unit: cm) at the operating frequency of the antenna and $\in_r$ represents the relative dielectric constant of the antenna material. When the thickness $L_3$ is lowered beyond the above mentioned range, the mechanical strength of the antenna itself is lowered and a crack or the like tends to occur. At the same time, a drop of the antenna gain and decrease of the bandwidth is caused and, hence, it becomes impossible for the antenna to make stabilized transmission and reception of radio waves. When the thickness $L_3$ is increased beyond the above range, the antenna size becomes too large and, hence, it becomes impossible to make the antenna smaller and thinner.

2. Radiator Electrode and Ground Electrode

A radiator electrode 2 and a ground electrode 3 are provided on first principal face 1*a* and second principal face 1*b* of substrate 1, respectively, as shown in FIGS. 1, 2, 3, and 4. Ground electrode 3 is provided with terminal portions 3*a*–3*e* which are respectively disposed on side faces 1*c* and 1*d* opposite to each other. Terminal portions 3*a* and 3*b* are disposed on side face 1*c* and terminal portions 3*c*–3*e* are disposed on side face 1*d*.

Although five terminal portions 3*a*–3*e* are provided in the present exemplary embodiment, the number of the terminal portions, which may be one or more than one, can be suitably changed depending on designing specifications of the antenna. Further, terminal portions may be disposed on other side faces than side faces 1*c* and 1*d*.

If anything, provision of a plurality of terminal portions 3*a*–3*e* on each of side faces 1*c* and 1*d* opposing each other as shown in FIG. 1 improves the mounting strength and the like.

Feeder electrodes 4*a* and 4*c* are formed exposed to the outside, extended from side face 1*c* to principal face 1*b*, and held in a non-contact state with ground electrode 3. More specifically, as shown in FIG. 1, recessed portion 3*f* is provided at a portion of ground electrode 3, feeder electrode 4*c* is disposed within recessed portion 3*f* with a gap left around the same, and feeder electrode 4*a* is provided also on side face 1*c*.

Further, there is provided a hole 5 in side face 1*c* as shown in FIG. 1. Within this hole 5, there is provided feeder electrode 4*b* with an electrode material applied to its inner wall surface. Accordingly, the feeder electrode has a configuration in which three electrodes 4*a*, 4*b*, and 4*c* are electrically connected with each other.

Feeder electrode 4*a* functions mainly as an external feeder portion. Since feeder electrode 4*b* is disposed within a space formed between the radiator electrode surface and the ground electrode surface, its own inductance and the static capacitance between the same and other electrodes can be varied in accordance with its length. Thus, the feeder electrode 4*b* has a function of adjusting the input impedance of the antenna.

By having hole 5 not filled up with an electrode material but left vacant, even if there is a difference of thermal expansion coefficient between feeder electrode 4*b* and substrate 1, the thermal stress is absorbed by the hollowed portion. Hence, production of a crack in substrate 1 or accumulation of stress in substrate 1 and feeder electrode 4*b* to deteriorate the antenna characteristics can be prevented. This structure is advantageous because a portable remote terminal with the surface-mount type antenna of the present exemplary embodiment mounted thereon can be used in an environment where temperature difference is extreme.

3. Feeder Electrode (a) Depth of Hole

Figure 3:
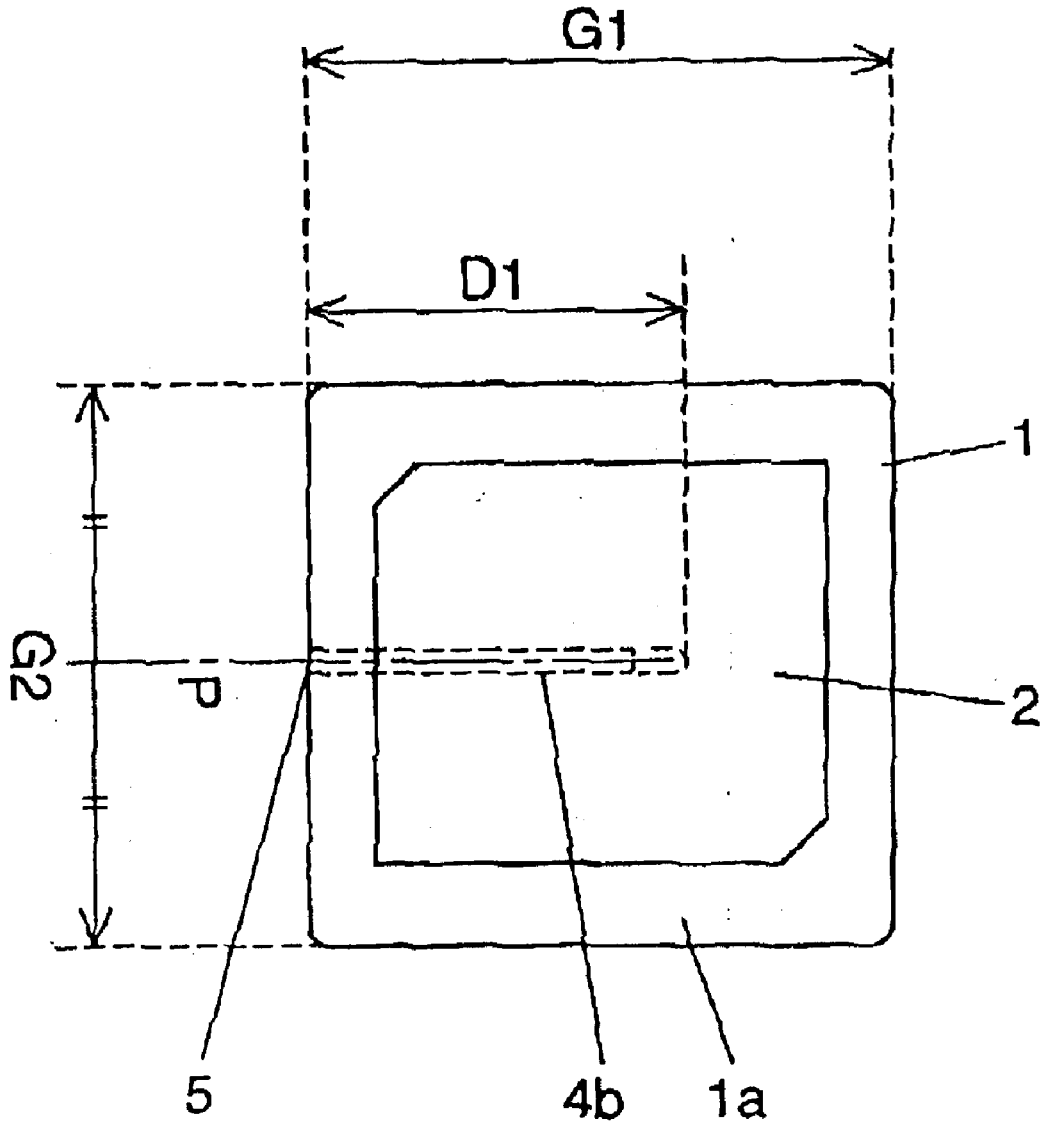
FIG. 3 is a plan view of the surface-mount type antenna according to exemplary embodiment 1 of the invention.
Figure 4:
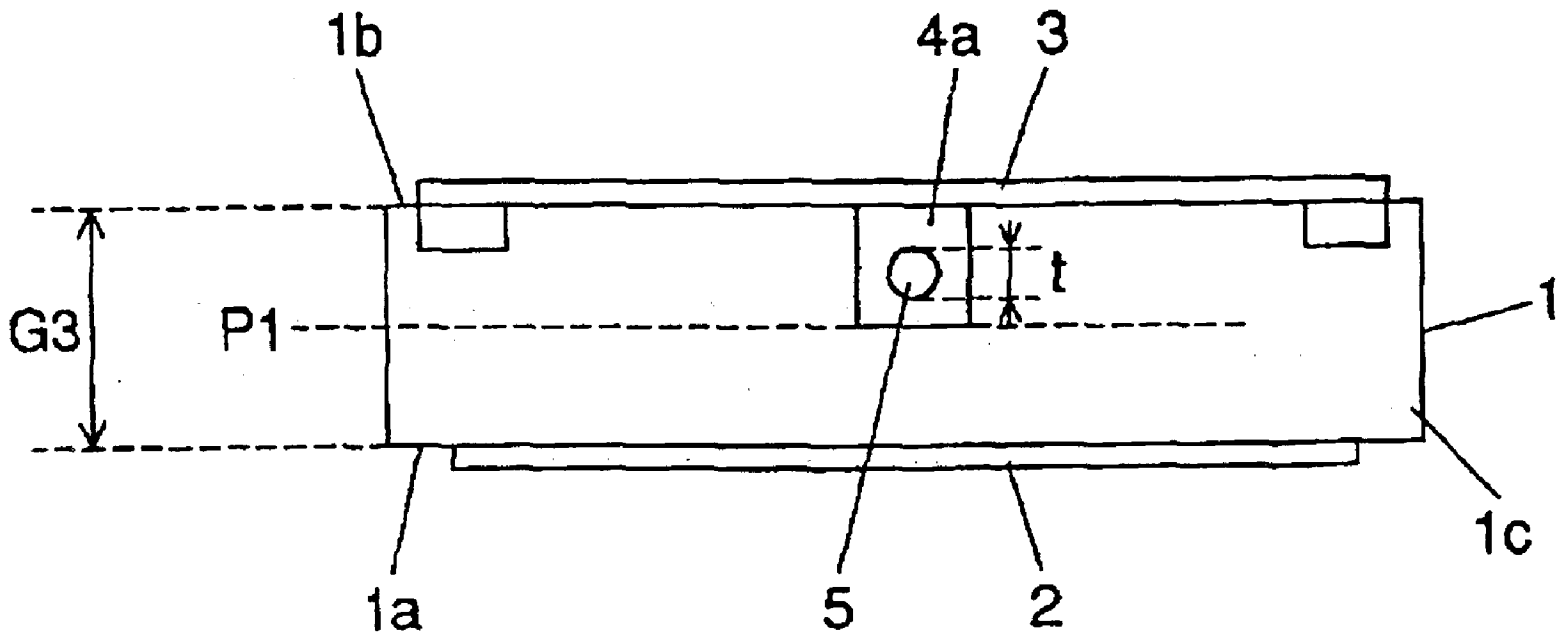
FIG. 4 is a side view of the surface-mount type antenna according to exemplary embodiment 1 of the invention.

With reference to FIG. 3, depth $D_1$ of hole 5 forming feeder electrode 4*b* is preferred to be determined to satisfy expression: $K=D_1/G_1>0.08$, where $G_1$ represents the length of substrate 1. When K=1, hole 5 becomes a through hole. If K is below 0.08, the length of feeder electrode 4*b* becomes too small and, hence, the static capacitance between feeder electrode 4*b* and the radiator electrode and between the same and the ground electrode become small, and, hence, a desired characteristic becomes unobtainable. Therefore, a preferable range of K is given by $0.08<K\leqq 1$. A more preferable range is $0.1<K\leqq 0.5$, in which sufficiently good antenna characteristics can be obtained.

(b) Position of Hole

Although it is preferred that the center of hole 5 be positioned on center line P of breadth G2 of substrate 1 as shown in FIG. 3, a deterioration in the characteristics is not caused even if it deviates G2/10 or so from centerline P to both sides.

It is preferred that hole 5 be shifted from center line P1 toward ground electrode 3 in the direction of the thickness of substrate 1. By such arrangement of hole 5, the distance between feeder electrode 4*b* and radiator electrode 2 can be made larger than the distance between feeder electrode 4*b* and ground electrode 3 and, thereby, the adjustment of the antenna characteristics becomes easier, thereby improving productivity.

(c) Diameter of Hole

A size of hole 5, denoted by t, in the direction of the thickness of substrate 1 is preferred to be set within a range of 0.1–0.55 when the substrate thickness G3 is given by 1. When it is 0.1 or below, formation of feeder electrode 4*b* becomes difficult and, when it is 0.55 or above, the mechanical strength of substrate 1 is lowered and, further, since feeder electrode 4*b* comes closer to radiator electrode 2, the adjustment of the antenna characteristics becomes difficult, thereby lowering productivity.

(d) Shape of Hole

A cross-section of hole 5 is preferred to be a circular, elliptical, or rectangular shape, with most part thereof being not parallel to ground electrode 3 and radiator electrode 2.

In the case of hole 5 having a rectangular shape whose longer side is parallel and opposite to ground electrode 3 and radiator electrode 2, the adjustment of the antenna characteristics becomes difficult, thereby deteriorating productivity.

A rectangular sectional shape is not entirely bad. In the case where the shorter side, as referred to above, of the rectangular sectional shape is parallel and opposite to ground electrode 3 and radiator electrode 2, the adjustment of the antenna characteristics can be made easily and no problem arises.

As described above, by forming feeder electrode 4*b* on hole 5 and by interconnecting the same and feeder electrodes 4*a* and 4*c* to provide a feeder electrode assembly, an inductance is produced for each of feeder electrodes 4*a*, 4*b*, and 4*c* and a static capacitance is provided between ground electrode 3 and each of feeder electrodes 4*a*, 4*b*, and 4*c*, as well as between radiator electrode 2 and each of feeder electrodes 4*a*, 4*b*, and 4*c*. Thereby, the input impedance matching for the antenna is made sufficiently well.

4. Electrode Material

As materials of radiator electrode 2, ground electrode 3, and feeder electrodes 4*a*, 4*b*, and 4*c*, simple metallic substance such as Ag, Au, Cu, and Pd, an alloy of these metallic substances, or an alloy of such metallic material and other metal (such as Ti, Ni, and the like) are used. Of these materials, Ag, or an alloy of Ag and another metallic material, is preferably used because of excellence of the characteristic provided thereby and of workability when forming the electrode.

Each electrode may be formed by a single layer or multiple layers. More specifically, a metallic protection layer of Au, Pt, or Ti having a good corrosion resistive property may be formed on the surface of each electrode for enhancement of corrosion proof or rust-preventing property.

Further, for the same purpose, the electrode surface may be chemically treated to form a protection film of epoxy group or silicon group resin thereon. Further, each electrode may be mixed with at least one of such elements as oxygen, nitrogen, and carbon of an amount not affecting the characteristic, as an impurity substance.

Further, a film of another metallic material may be formed as a buffer layer between substrate 1 and each electrode to obtain improved bonding strength and the like.

5. Method for Fabricating Electrode

In forming electrodes, such methods as printing, plating, and sputtering are used. When it is especially desired to provide a relatively thin film thickness of the electrode, a sputtering method and a plating method are preferable, whereas when it is desired to provide a relatively thick film thickness, a printing method is preferable. In the case of the present exemplary embodiment, a printing method providing good productivity is used. A paste having metallic powders of Ag, glass frits, and a solvent mixed therein is applied to the surface of substrate 1 so as to form a predetermined pattern and then the product is subjected to a heat treatment and, thereby, each electrode is produced.

It is preferred that the film thickness of each electrode be 0.01–50 $\mu$m (more preferably, 1–40 $\mu$m). When the film thickness of an electrode is smaller than 0.01 $\mu$m, it sometimes occurs that the film thickness becomes thinner than the skin depth and the antenna gain is thereby lowered.

When the film thickness of an electrode becomes 50 $\mu$m or larger, falling off of the electrode tends to occur and, in addition, a disadvantage of increased material cost arises due to increases in the amount of coating.

6. Antenna Characteristics

Figure 5:
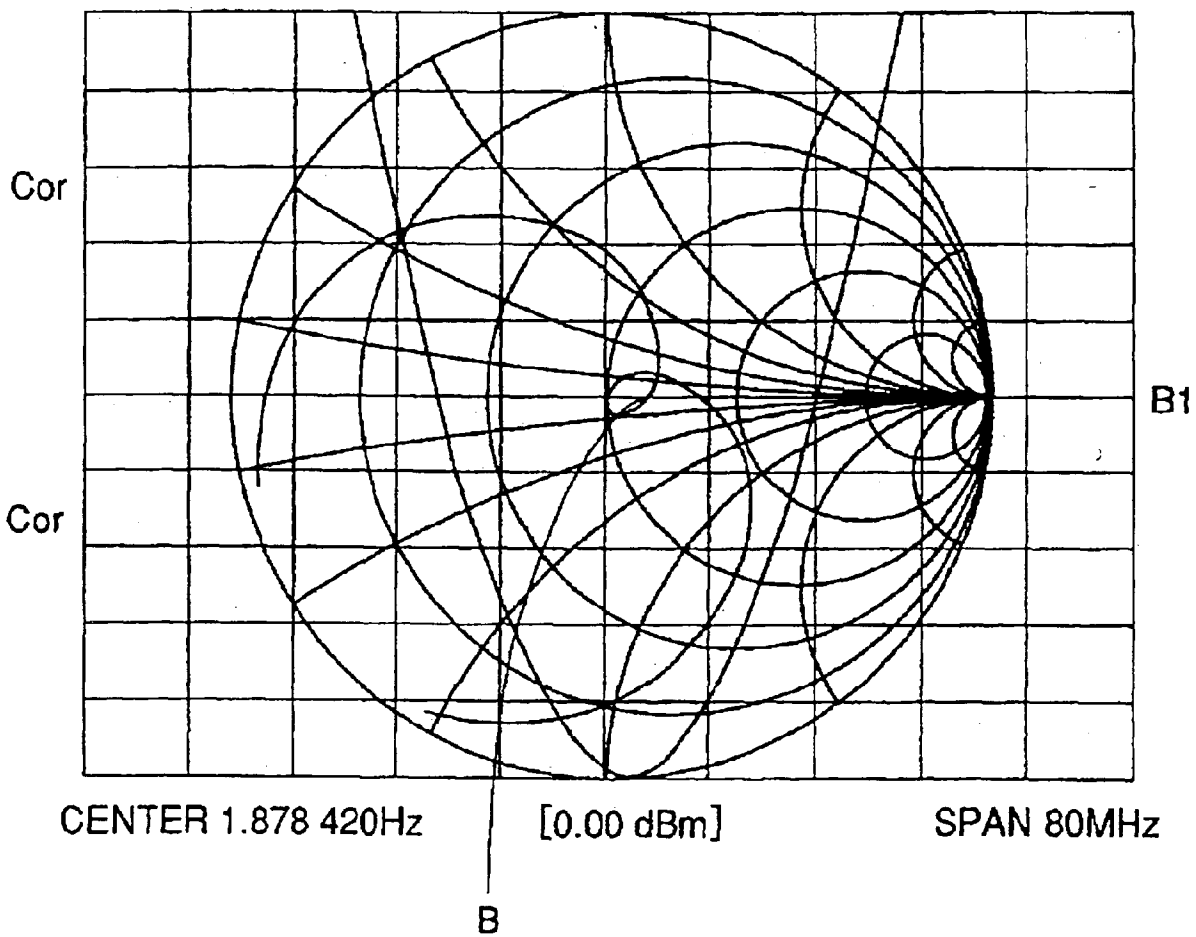
FIG. 5 is a diagram showing input impedance and VSWR frequency characteristics of the surface-mount type antenna according to exemplary embodiment 1 of the invention.

FIG. 5 is a chart showing input impedance and VSWR frequency characteristics of a surface-mount type antenna in exemplary embodiment 1 of the present invention. As shown in FIG. 5, the antenna of the present embodiment has point B lying along center line B1 of the Smith chart and located at the middle point. Generally, the input impedance of an rf circuit is frequently matched with 50 Ω. In this case, it is known from FIG. 5 that the input impedance is matched with 50 Ω.

Figure 6:
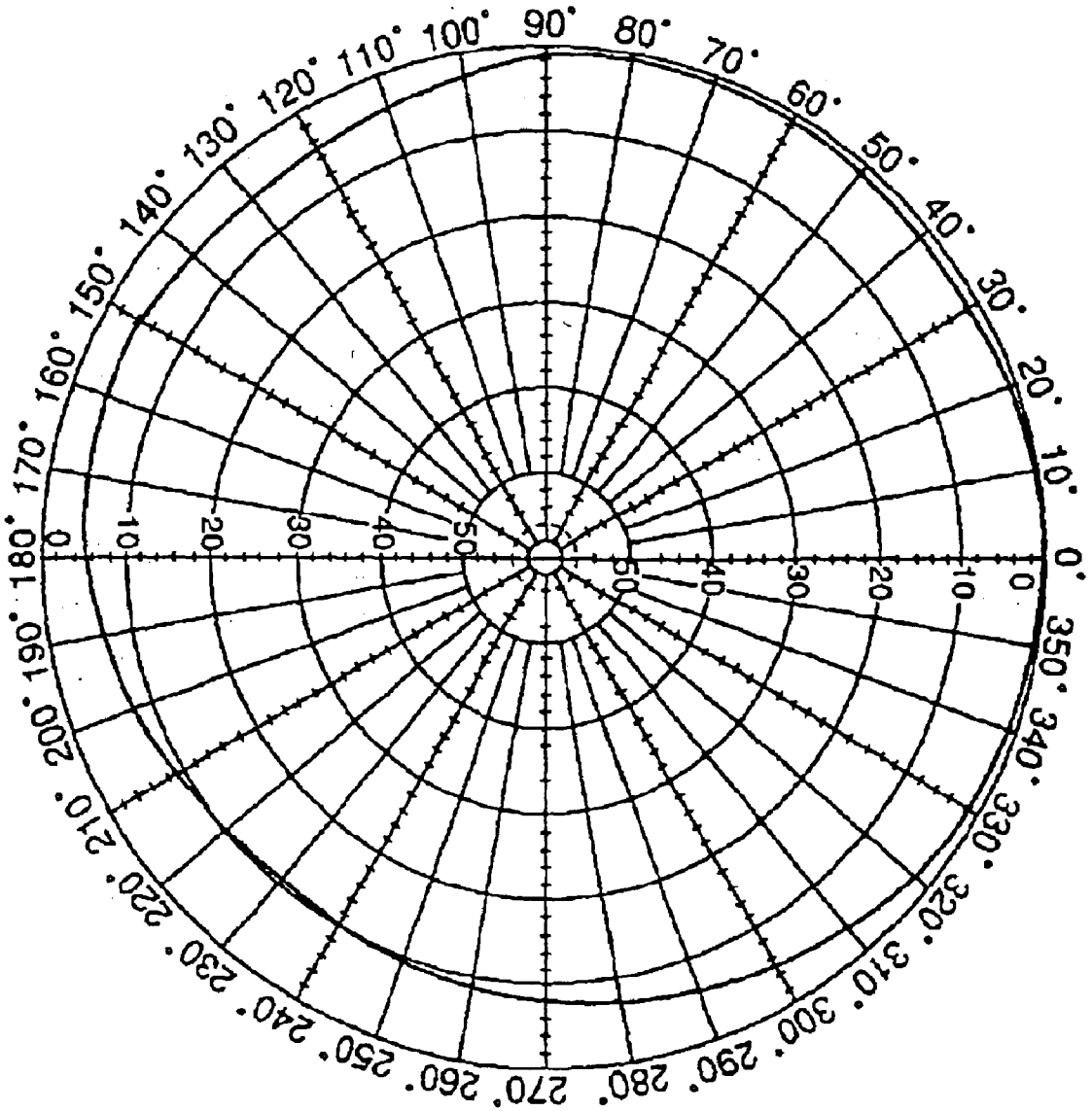
FIG. 6 is a diagram showing a directivity characteristic of the surface-mount type antenna according to exemplary embodiment 1 of the invention.

A directivity characteristic of the surface-mount type antenna of embodiment 1 of the invention is shown in FIG. 6. It is known that the antenna has a good characteristic over a range from the direction of the zenith (angle of elevation: 90°) to the direction of the horizon (angle of elevation: 0°).

In the present exemplary embodiment, feeder electrode 4*b* has been provided by forming the electrode all over the inner wall face of hole 5, while not filling up the interior of hole 5 with the electrode material. However, the electrode may be formed on a portion of the inner wall. By virtue of this arrangement, all of substrates 1 may be fabricated so as to have hole 5 of the same depth and, thereafter, the length of feeder electrode 4*b* formed in hole 5 may be adjusted according to the specifications of the antenna. Thus, it becomes unnecessary to change the length of the hole itself case by case and, hence, component sharing can be made. As one concrete example, after a dielectric or insulating material is filled to a predetermined length from the bottom portion of hole 5 of a constant depth, a feeder electrode may be formed on the inner wall surface. Thus, the length of feeder electrode 4*b* can be adjusted easily.

As described above, a surface-mount type antenna small in size, producing small variations in characteristics, and excellent in productivity and reliability can be realized by the present exemplary embodiment.

<<Exemplary Embodiment 2>>

Figure 7A:
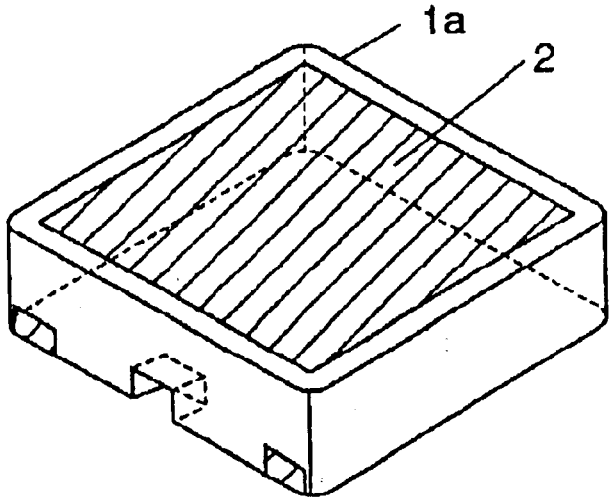
FIG. 7 is a perspective view of a surface-mount type antenna according to exemplary embodiment 2 of the invention.
Figure 7B:
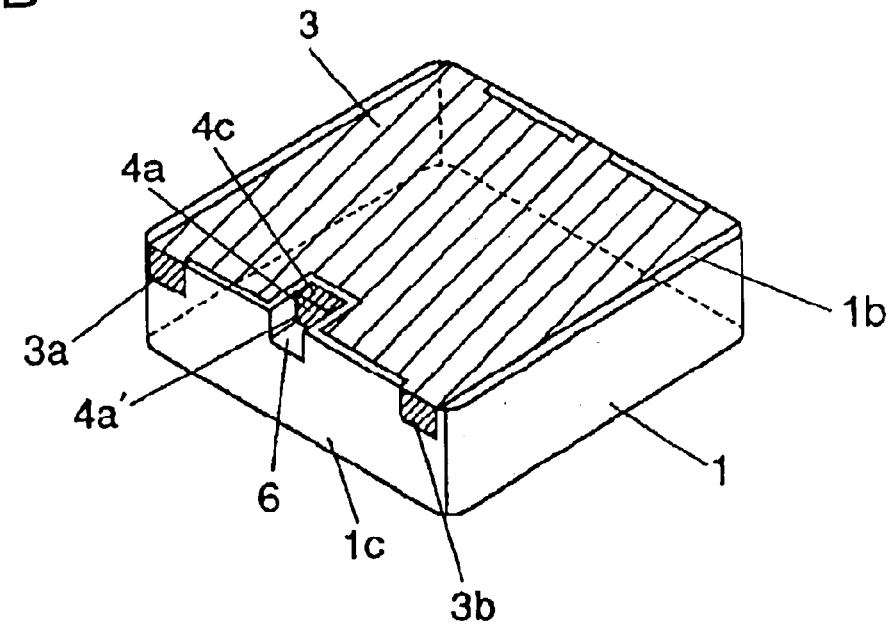

FIG. 7 shows a perspective view of a surface-mount type antenna according to exemplary embodiment 2 of the present invention.

There is provided a step portion 6 extended from side face 1*c* to principal face 1*b* of substrate 1 by cutting a portion off side face 1*c* and principal face 1*b* as shown in FIG. 7 to form feeder electrode 4*a* on one step face 4*a*' of step portion 6 (hereinafter, "step face" means each of two faces along the principal face and along the side face at the stepped portion). By virtue of this structure, a signal fed into feeder electrode 4*a* produces electromagnetic coupling between the edge portion of feeder electrode 4*a* and radiator electrode 2, whereby a function as an antenna is obtained. At this time, since feeder electrode 4*a* is placed inwardly from the outside shape of substrate 1 because of the provision of step portion 6, it can have a more suitable and stable electrode arrangement in feeding signals into radiator electrode 2. Thus, stabilized antenna characteristics can be obtained.

Further, when the antenna of the present exemplary embodiment is mounted on a printed board, a higher strength against bending stress on the substrate can be obtained because the soldered portion of the feeder electrode is placed inwardly from the circumference of substrate 1.

<<Exemplary Embodiment 3>>

Figure 8A:
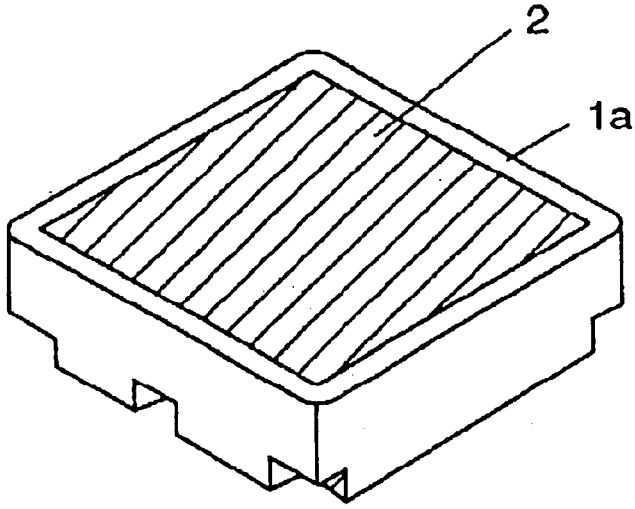
FIG. 8 is a perspective view of a surface-mount type antenna according to exemplary embodiment 3 of the invention.
Figure 8B:
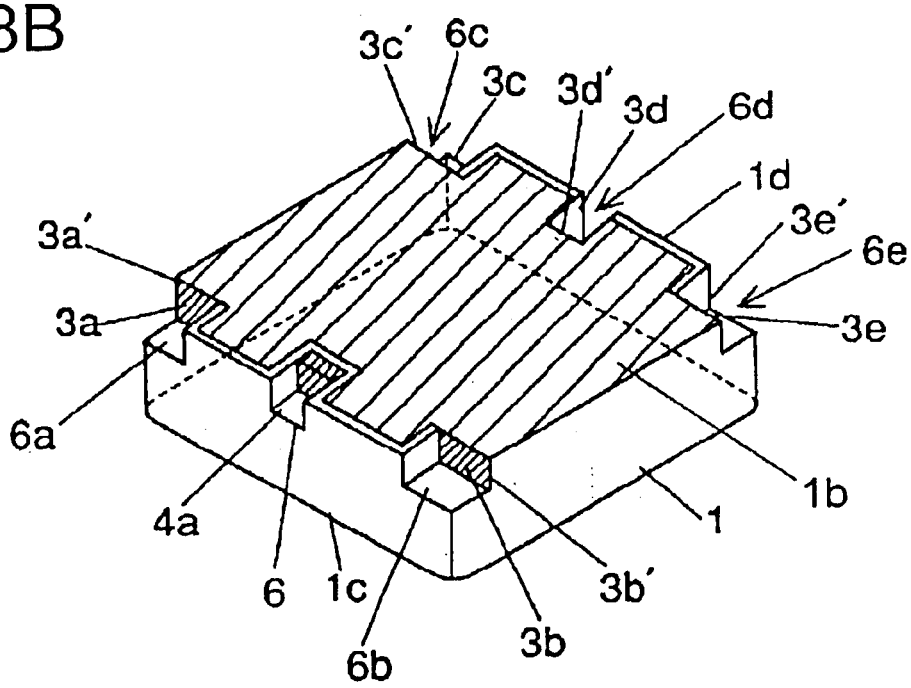

FIG. 8 shows a perspective view of a surface-mount type antenna of exemplary embodiment 3 of the present invention.

Step portions 6*a*, 6*b*, 6*c*, 6*d*, and 6*e* equivalent to step portion 6 (FIG. 7) formed in exemplary embodiment 2 are provided extended from side faces 1*c* and 1*d* to principal face 1*b* as shown in FIG. 8. Then, fixed electrodes 3*a*, 3*b*, 3*c*, 3*d*, and 3*e* are provided on step faces 3*a*', 3*b*', 3*c*', 3*d*', and 3*e*' of step portions 6*a*, 6*b*, 6*c*, 6*d*, and 6*e*.

In the surface-mount type antenna structured as described above, since soldered portions of the electrodes are recessed further inwardly from the circumference of substrate 1 than in embodiment 2, a higher strength can be obtained against bending or flexure of the substrate when the antenna is mounted on a printed board, whereby reliability of the antenna can be enhanced. Further, the size of the land pattern formed on a printed board on which the antenna of the present embodiment is mounted can be placed within the outside size of the antenna, and therefore, a decrease in space of the printed board can be achieved.

<<Exemplary Embodiment 4>>

Figure 9A:
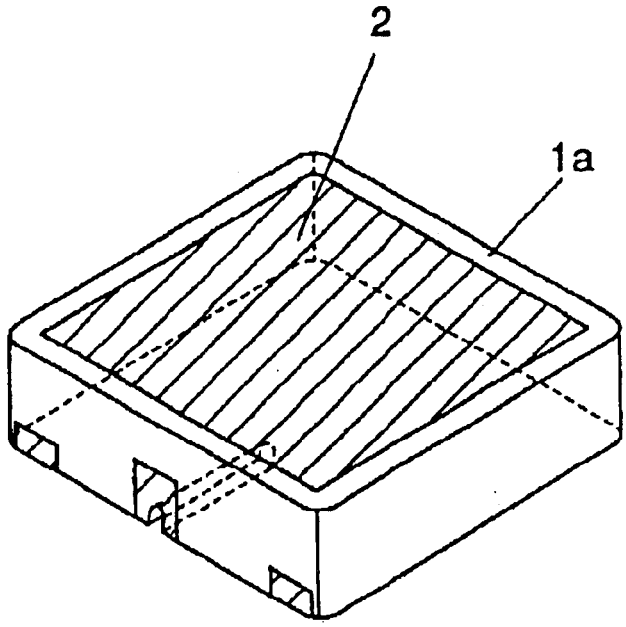
FIG. 9 is a perspective view of a surface-mount type antenna according to exemplary embodiment 4 of the invention.
Figure 9B:
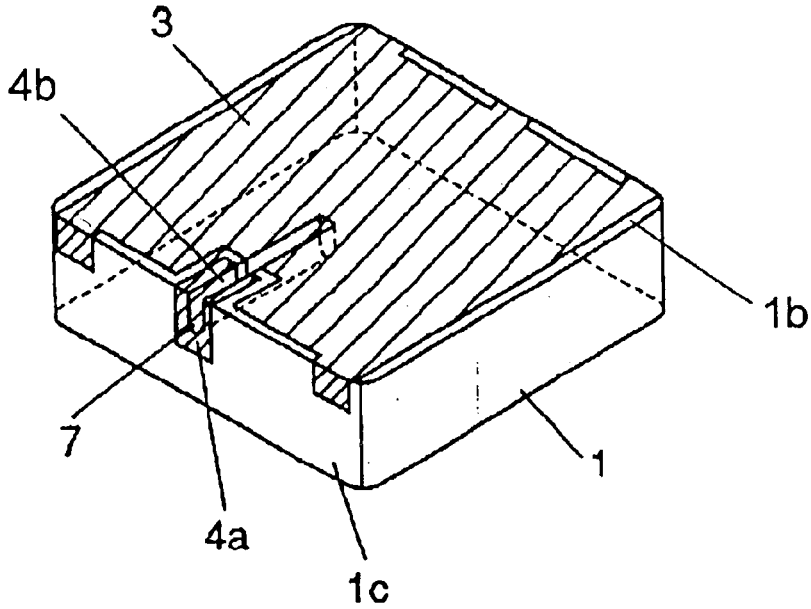

FIG. 9 shows a perspective view of a surface-mount type antenna according to exemplary embodiment 4 of the present invention. In the present embodiment, a groove 7 as shown in FIG. 9 is provided in principal face 1*b* instead of hole 5 shown in FIG. 1. Feeder electrode 4*b* is formed on the inner wall surface of groove 7 and the same is electrically connected with feeder electrode 4*a* formed on side face 1*c* of substrate 1 as shown in FIG. 9.

Formation of such groove 7 is easier than formation of a hole in the fabricating process and such an advantage can be obtained that provision of an electrode on the inner wall surface is also easier.

<<Exemplary Embodiment 5>>

Figure 10A:
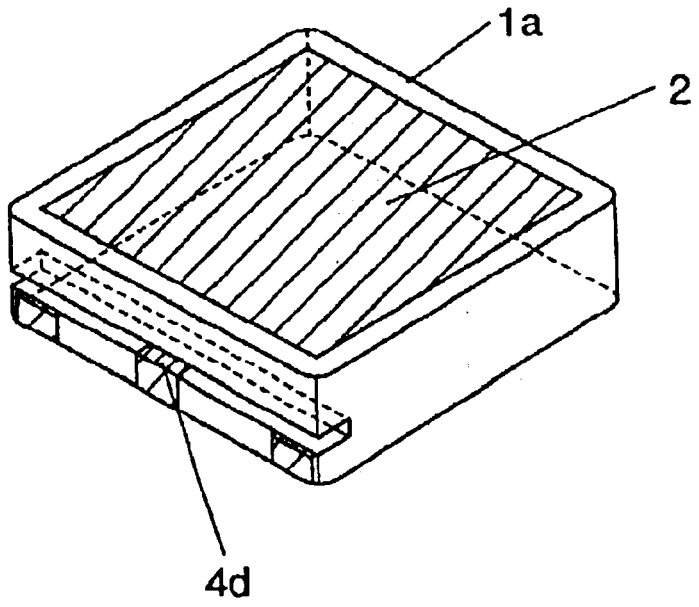
FIG. 10 is a perspective view of a surface-mount type antenna according to exemplary embodiment 5 of the invention.
Figure 10B:
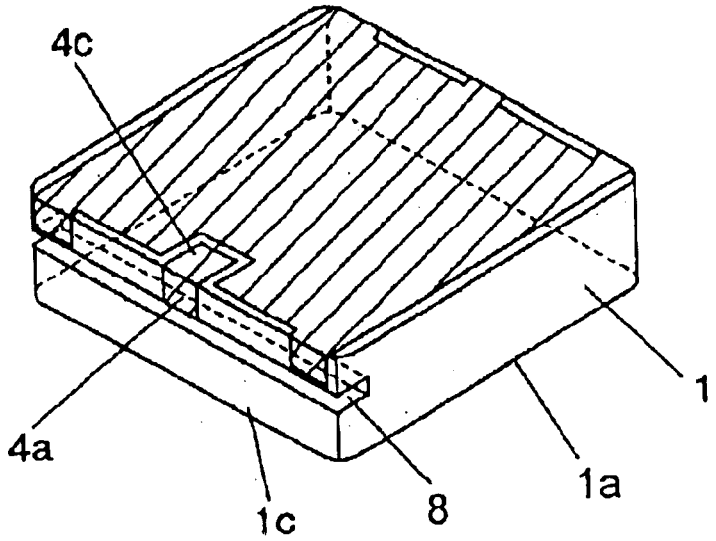

FIG. 10 shows a perspective view of a surface-mount type antenna according to exemplary embodiment 5 of the present invention. A slit 8 is formed in side face 1*c* of substrate 1 parallel to the direction of the width or length of substrate 1, perpendicular to the direction of the thickness of the same, and on the side closer to the ground electrode. Feeder electrodes 4*c* and 4*a* formed on principal face 1*b* and side face 1*c*, respectively, are electrically connected with feeder electrode 4*d* in slit 8 formed on a portion of one of the two inner side faces, which is closer to principal face 1*b*. (Note that feeder electrode 4*d* is not on the bottom face of the slit 8.)

The surface-mount type antenna structured as described above allows a signal to be passed through feeder electrode 4*c* and 4*a* and electromagnetic coupling to be produced between the open end of feeder electrode 4*d* and radiator electrode 2 and, thus, it functions as an antenna. The surface-mount type antenna has no need to embed the feeder electrode in the substrate 1. Further, since slit 8 can be produced more easily than hole 5 in exemplary embodiment 1, such advantages can be obtained that the adjustment of the antenna characteristics becomes easier and productivity is enhanced.

<<Exemplary Embodiment 6>>

Exemplary embodiment 6 is an example of a use of the surface-mount type antenna of each embodiment for a mobile remote terminal.

Figure 11:
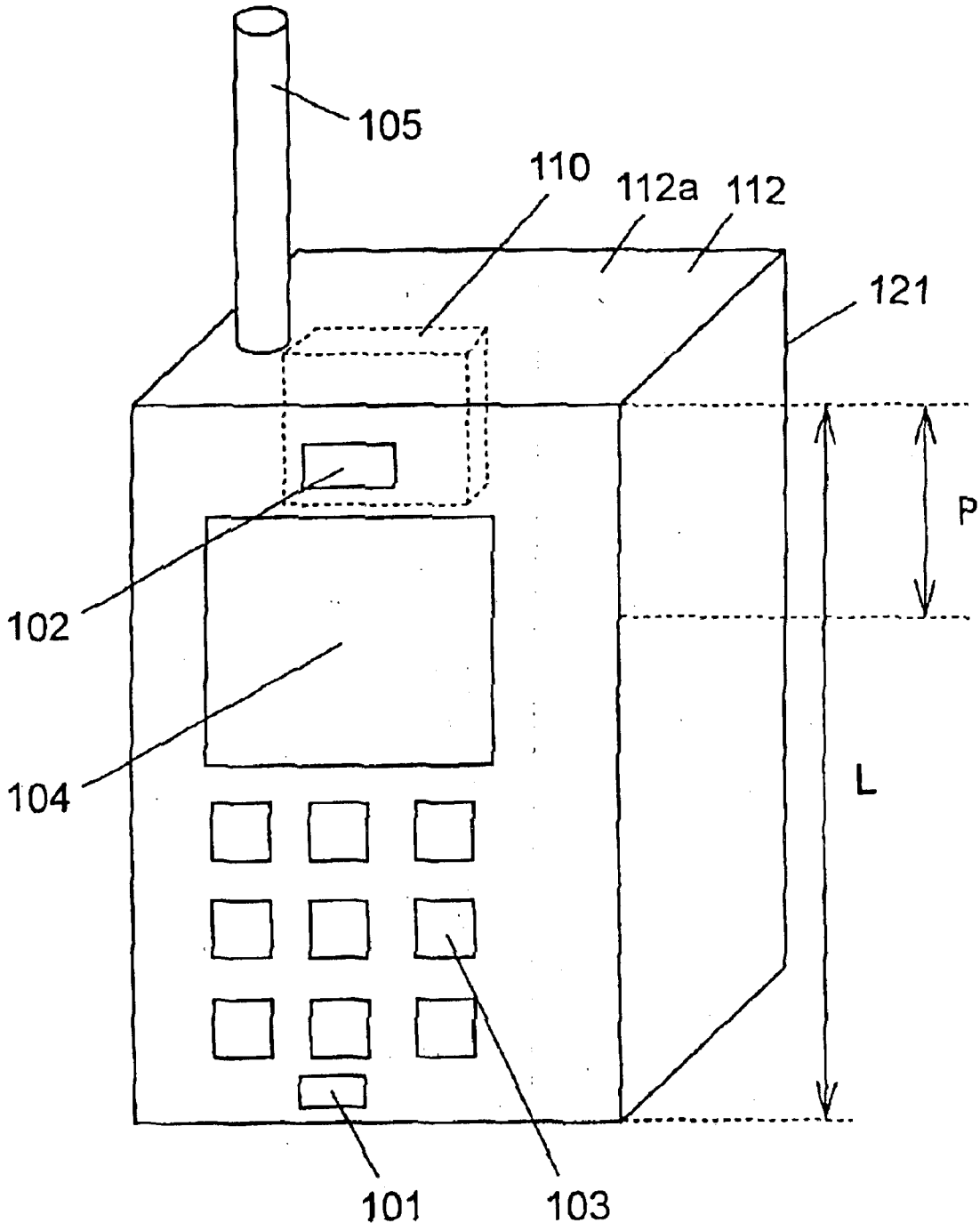
FIG. 11 is a perspective view showing a mobile communication terminal according to exemplary embodiment 6 of the invention.
Figure 12:
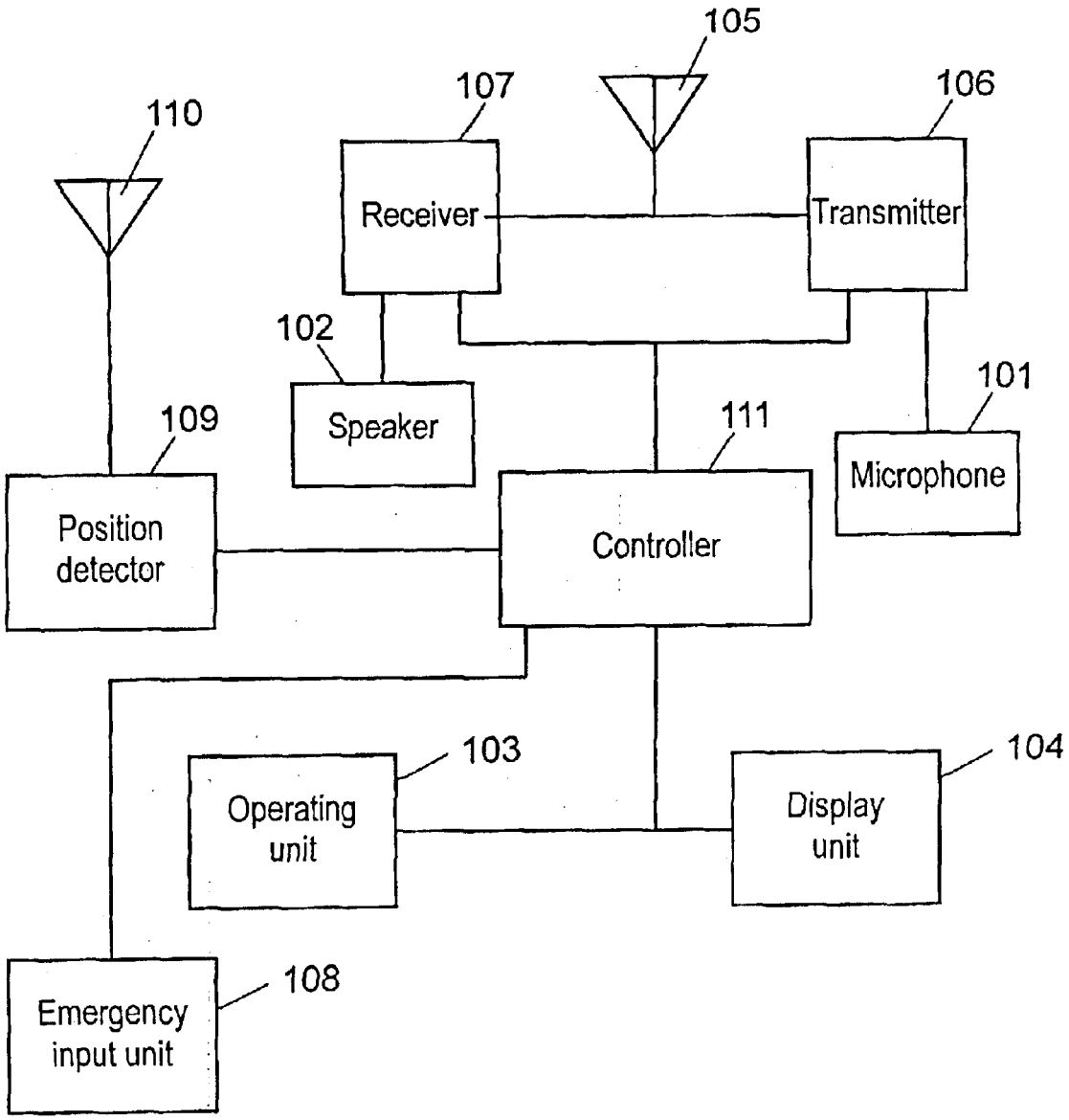
FIG. 12 is a block diagram showing the mobile communication terminal according to exemplary embodiment 6 of the invention.

In a mobile remote terminal of the present embodiment shown in FIG. 11 and FIG. 12, a signal is received by a transmit-receive antenna 105 at the time of call in. Thereupon, a controller 111 allows the received information to be displayed on a display unit 104 and sets the terminal at a call-in mode to establish a communication. Then, transmission and reception of voice and data are performed.

On the other hand, at the time of call out, the party on the other end of the connection is selected by an operating unit 103, and controller 111 allows transmitter 106 to generate a transmission signal and radiate it out into space, and, at the same time, sets the terminal at a call-out mode. Then, upon receiving a signal from the party on the other end, the controller 111 establishes a communication and performs transmission and reception of voice and data.

Further, at the time of making an emergency call, an emergency signal is generated from an emergency input unit 108 and, then, controller 111 allows a transmitter 106 to generate a transmission signal to be radiated out into space through an antenna 105.

After a communication is established, a transmitted signal from GPS is received by a planar antenna 110 and information of the present position obtained by detection in a position detector 109 is radiated from antenna 105. Although, in this case, one piece of antenna 105 is used in the drawing, such cases are also possible in which diversity antennas, antennas for a dual or triple type mobile communication terminal to be applicable for a plurality of communication systems, or a plurality of antennas are used.

Further, in cases where a dual or triple type mobile communication terminal is used, a plurality of transmitters 106 and receivers 107 are sometimes provided therein.

An emergency input unit 108 that allows inputting to be made by a simple operation is preferred, and it may sometimes be constructed of various sensors. As planar antenna 110, a surface-mount type antenna described in any of embodiments 1–5 is used.

While a general outline of the present embodiment was described above, each unit of the present embodiment will be described below in detail.

1. Operating Unit 103

Operating unit may for example be constituted of a combination of a plurality of buttons as shown in FIG. 11 or it may be such that it has a rotatable or revolvable member, not shown, provided in a case 112 and allows, by rotation or revolution of such a member, characters and menus to be sequentially displayed for selection on display unit 104. Otherwise, voice-operated entry or handprint entity may be used.

2. Display Unit 104

As display unit 104, an LED, an organic electroluminescent (EL) display, or that having a plurality of LEDs mounted thereon may be used. Further, a monochrome display, color display, or partly color display may be used.

3. Emergency Input Unit 108

As emergency input unit 108, such a device, not shown, may be used, which, by having a button or the like not normally in use provided on case 112, allows an emergency signal to be generated from emergency input unit 108 by a push on the button or, by having various sensors such as a temperature sensor and a shock sensor disposed on the inside or outside of case 112, allows a sensor to generate a detected signal in emergency. When a shock sensor is used, for example, case 112 may be collided against the ground in an emergency. Then, the shock sensor detects a shock at this time to generate a detected signal and, in response thereto, emergency input unit 108 generates an emergency signal.

Further, it is also possible to allow an emergency signal to be generated by having a special button on operating unit 103 depressed for a long time or by having a specific key word entered. In such a case, provision of emergency input unit 108 becomes unnecessary. Thus, by providing operating unit 103 with the function of emergency input unit 108, this emergency input unit 108 can be eliminated to simplify the apparatus.

4. Planar Antenna 110

Planar antenna 110 is preferred to be disposed at the rear of a speaker 102 as shown in FIG. 11 so that the principal face of antenna 110 directly confronts speaker 102. On the back side of such units as operating unit 103, except for speaker 102, there are disposed other circuit boards. Therefore, if antenna 110 is disposed there, mobile communication terminal 121 itself becomes thick or a portion of case 112 comes to bulge at this position. Then, not only appearance is impaired but also antenna 110 is shielded to lower the receiving sensitivity. Furthermore, since the antenna is shielded by hand while the terminal is operated, undesired deterioration of the receiving sensitivity is caused.

Figure 13:
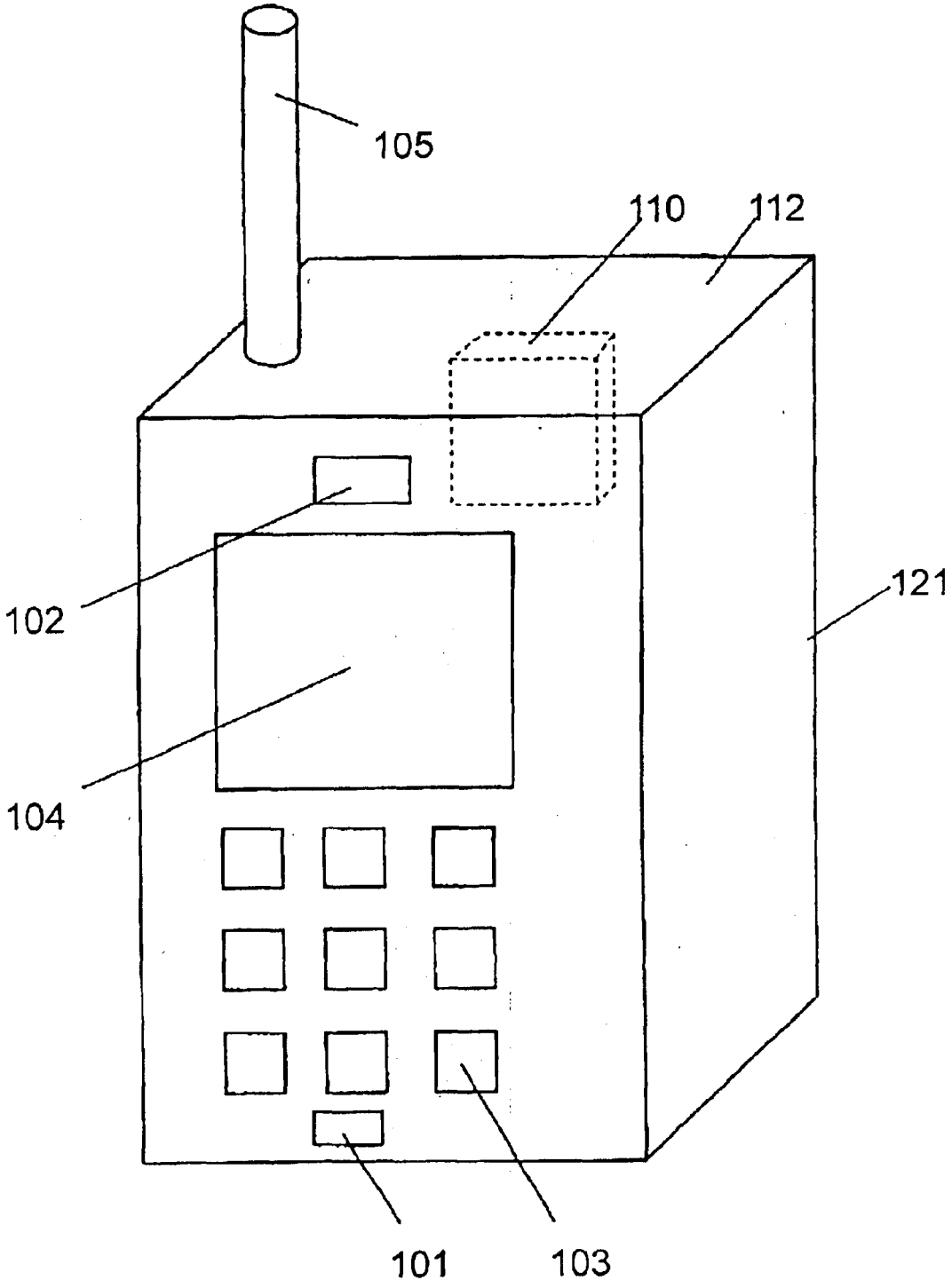
FIG. 13 is a perspective view showing a mobile communication terminal according to another preferred embodiment of exemplary embodiment 6 of the invention.

Further, terminal 121 can be made thinner by juxtaposing planar antenna 110 and speaker 102 as shown in FIG. 13.

Figure 14:
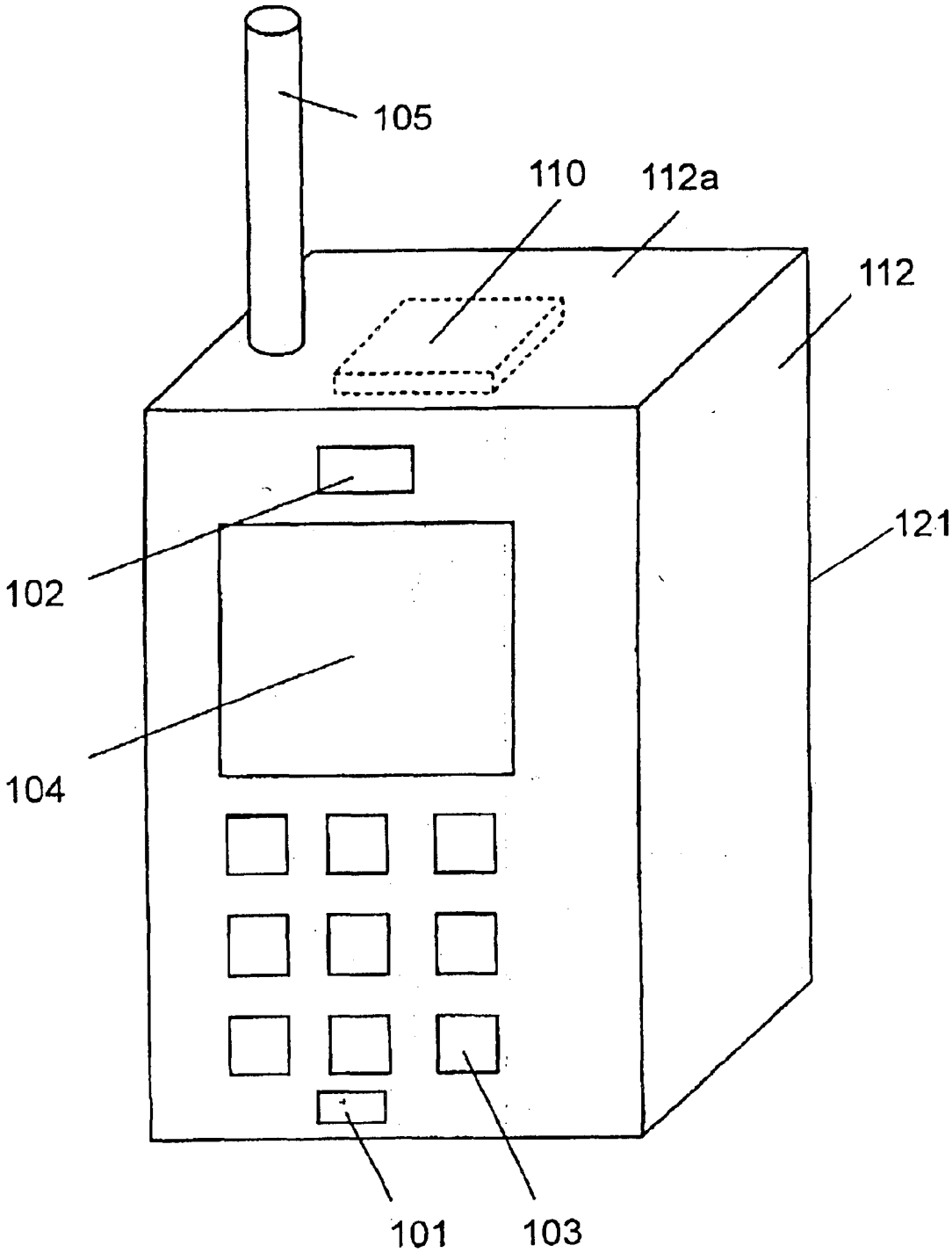
FIG. 14 is a perspective view showing a mobile communication terminal according to a further preferred embodiment of exemplary embodiment 6 of the invention.

Although the terminal becomes somewhat thicker, by arranging the top face of case 112 and the principal face of antenna 110 to confront each other as shown in FIG. 14 or by arranging the antenna to be tilted a predetermined angle so that the surface of the radiator electrode of antenna 110 is turned toward the zenith during the time of communication, the receiving sensitivity can be enhanced.

Since planar antennas 110 are the surface-mount type antennas of the present invention providing high productivity, the mobile communication terminals of the present exemplary embodiment also provides enhanced productivity. Especially, micro-strip antennas employing a substrate having an excellent high-frequency characteristic, such as a substrate of fluoro-carbon resin and of dielectric ceramic, relative dielectric constant $\in_r$ of which is within a range of 4–150, are preferably used for micro-strip antennas 110. Using a dielectric ceramic substrate of which $\in_r$ is within a range of 20–150, in particular, can constitute an antenna being small in size but having a high receiving sensitivity and, hence, the same is very much suited for miniaturization of the terminal.

When arrangement of planar antenna 110 is considered quantitatively, it is preferred that $P<0.35\times L$ be satisfied, where L and P represent the sizes of mobile communication terminal and planar antenna 110, respectively, measured from top face 112*a* of the case as shown in FIG. 11. More preferable condition is $P<0.3\times L$, and still more preferable condition is $P<0.25\times L$. The same rule applies to the case shown in FIG. 13.

As described above, by having planar antenna 110 incorporated in mobile communication terminal 121, a mobile communication terminal being small in size, having good receiving sensitivity, and providing high productivity and reliability can be realized virtually without the need for changing other components and layout of members.

5. Operation (a) At the Time of Call In

When there is a call in, a call-in signal is sent from receiver 107 to controller 111. Controller 111, in response to the call-in signal, allows display 104 to display predetermined characters and the like.

When a button for accepting the call in is depressed in operating unit 103, controller 111 receives the signal from the operating unit and sets each unit at a call-in mode.

Thereafter, a signal received by antenna 105 is converted into a voice signal in receiver 107 and the voice signal is delivered as a voice from speaker 102. A voice fed in from microphone 101 is converted into a voice signal and radiated out into space through transmitter 106 and antenna 105.

(b) At the Time of Call Out

When making a call out, a signal to make a call out is sent from operating unit 103 to controller 111. Then, a signal denoting the telephone number of the party on the other end of the connection is sent from operating unit 103 to controller 111. Upon receipt of the signal, controller 111 allows transmitter 106 to generate a transmission signal including the telephone number so as to be radiated out into space from antenna 105.

When the party on the other end has received the signal and a communication has been established, antenna 105 receives an acknowledge signal transmitted from the party on the other end. Receiver 107 detects the acknowledge information and sends it to controller 11. Thereupon, controller 111 sets each unit at a call-out mode.

Thereafter, a signal received by antenna 105 is converted into a voice signal in receiver 107 and the voice signal is delivered from speaker 102 as voice. Voice fed in from microphone 101 is converted into a voice signal and radiated out into space through transmitter 106 and antenna 105.

(c) At the Time of Emergency Call

Figure 15:
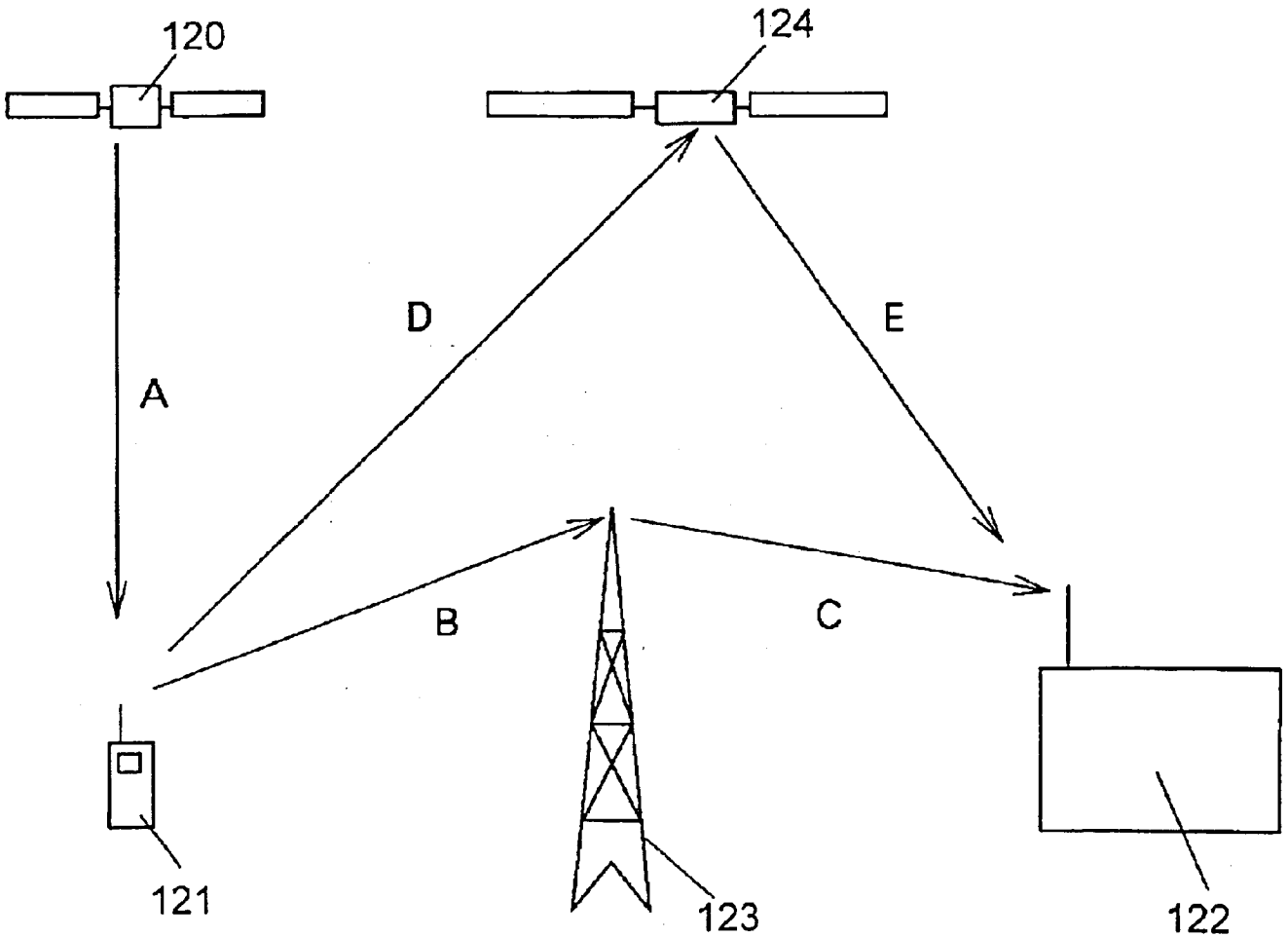
FIG. 15 is a drawing showing an outline of a system using the mobile communication terminal according to exemplary embodiment 6 of the invention.

FIG. 15 shows a communication system for use in an emergency. An example of operation at the time of an emergency call will be described with reference to FIG. 12 and FIG. 15.

When a transmitted signal A (FIG. 15) from at least three GPS satellites 120 is received by planar antenna 110 (FIG. 12), position detector 109 (FIG. 12) measures the position of mobile communication terminal 121 (FIGS. 11–14). At this time, position measurement by planar antenna 110 and position detector 109 is carried out, for example, at all times, intermittently (at regular intervals), or upon an inputting operation made in operating unit 103.

When power saving in mobile communication terminal 121 itself is not needed to be considered, it is desired that the measurement be carried out at all times. This provides an advantage that accurate position information can be obtained.

When, on the other hand, power saving is to be considered, the measurement is carried out at regular intervals and hence an advantage is obtained that consumed power in terminal 121 can be reduced.

In the event of an emergency, information of occurrence of the emergency is fed in from emergency input unit 108 or operating unit 103. When the signal is transmitted to controller 111, controller 111 calls up the telephone number of a specific office 122 (such as the police, a fire department, and a first-aid center) stored in its own memory or another memory unit and radiates the transmission signal out into space through transmitter 106 and antenna 105. When it is detected by controller 111 that a communication is established with the party on the other end of the connection of the line through antenna 105 and receiver 107, controller 111 obtains the position information (the latitude and longitude) detected by position detector 109 at present or a short time before.

Then, the position information is transmitted to office 122 through transmitter 106 and antenna 105. At this time, predetermined messages (such as name, address, and chronic disease) may also be transmitted.

Mobile communication terminal 121 is in receipt of position information from transmitted signal A from GPS 120. Terminal 121 operates in emergency as described above and it first transmits signal B to base station 123. Then, base station 123 directly transmits signal C to office 122, whereby a communication is established between terminal 121 and office 122. Sometimes, base station 123 establishes a communication between terminal 121 and office 122 through a public switched telephone network.

Further, signal D is transmitted from terminal 121 to communication satellite 124 and communication satellite 124, in turn, sends signal E directly to office 122, whereby a communication is established between terminal 121 and office 122. Though it is not shown, signal D from communication satellite 124 may sometimes be sent to its earth station and the earth station establishes a communication between terminal 121 and office 122 through a public switched telephone network.

When mobile communication terminal 121 is capable of communicating with both base station 123 and communication satellite 124, controller 111 may control transmitter 106 so that a signal at a frequency for base station 123 is first transmitted therefrom. When a specific signal cannot be received within a predetermined period of time, controller 111 may judge that it is impossible to make a conversation with base station 123 and may, then, switch the communication over to that using communication satellite 124.

A concrete example of the operation of a mobile communication terminal 121 in an emergency will be described below. Assume that a vehicle with mobile communication terminal 121 mounted thereon had a traffic accident in a suburb and, as a result, the driver is seriously injured that he cannot speak. If the seriously injured person operates emergency input unit 108, the above described operations are performed in terminal 121 and such information as the present position is transmitted to office 122.

In response to the position information, office 122 urgently sends an emergency ambulance to the spot of the accident and performs such work as rescue of the injured person. However, in order not to mistakenly send an ambulance to the spot when emergency input unit 108 is erroneously operated at ordinary times, it may be arranged such that office 122, upon receipt of an emergency communication, sends back a voice or signal to the spot and dispatches an ambulance car only when the request for rescue is confirmed or when no answer is obtained. Thus, bidirectional confirmation of the fact can be made and a reliable system free from error can be structured.

While an example in which voice is transmitted and received has been described in the present embodiment, the same effect can be obtained when character data is transmitted and/or received.

As described in the foregoing, the present invention realizes a surface-mount type antenna small in size, showing only small variations in characteristics between products, and providing high productivity and reliability, as well as a communication terminal using the same.

What is claimed is:

1. A mobile communication terminal for use with a signal including position information, comprising:

a case having a top face and a height;

an antenna operable to receive the signal;

a position detector operable to detect the position information from the signal;

a controller operable to control an operation of said mobile communication terminal; and an emergency input unit for use by an operator of said mobile communication terminal to make an entry in an emergency;

wherein said antenna is positioned to be less than 0.35×L from said top face of said case, where L denotes the height of said case; and wherein said controller, when the operator makes the entry into said emergency input unit, is operable to establish a communication connection to a predetermined party.

2. The mobile communication terminal according to claim 1, wherein said antenna is operable to receive the signal from a GPS satellite.

3. The mobile communication terminal according to claim 1, wherein said antenna includes a ceramic material.

4. The mobile communication terminal according to claim 1, wherein said antenna is surface-mounted on a substrate disposed in said case.

5. The mobile communication terminal according to claim 1, further comprising a speaker contained in an upper portion of said case, and said antenna is contained in said case such that said antenna confronts a back side of said speaker.

6. The mobile communication terminal according to claim 1, further comprising a speaker juxtaposed with said antenna.

7. A mobile communication terminal for use with a first signal, including at least one of a data signal and a voice signal, and a second signal including position information, said mobile communication terminal comprising:

a case having a top face and a height;

a first antenna operable to receive and transmit the first signal;

a converter unit operable to perform at least one of generation of the first signal from at least one of the data signal and the voice signal, and generation of at least one of the data signal and the voice signal from the first signal;

a second antenna operable to receive the second signal;

a position detector operable to detect the position information from the second signal;

a controller operable to control an operation of said mobile communication terminal;

an emergency input unit for use by an operator of said mobile communication terminal to make an entry in an emergency;

wherein said second antenna is positioned to be less than 0.35×L from said top face of said case, where L denotes the height of said case; and wherein said controller, when the operator makes the entry into said emergency input unit, is operable to establish a communication connection to a predetermined party.

8. The mobile communication terminal according to claim 7, wherein said second antenna is operable to receive the second signal from a GPS satellite.

9. The mobile communication terminal according to claim 7, wherein said second antenna includes a ceramic material.

10. The mobile communication terminal according to claim 7, wherein said second antenna is surface-mounted on a substrate disposed in said case.

11. The mobile communication terminal according to claim 7, further comprising a speaker contained in an upper portion of said case;

wherein said second antenna is contained in said case such that said second antenna confronts a back side of said speaker.

12. The mobile communication terminal according to claim 7, further comprising a speaker juxtaposed with said second antenna.

13. A mobile communication terminal for use with a first signal, including at least one of a data signal and a voice signal, and a second signal including position information, said mobile communication terminal comprising:

a case;

a first antenna operable to receive and transmit the first signal;

a converter unit operable to perform at least one of generation of the first signal from at least one of the data signal and the voice signal, and generation of at least one of the data signal and the voice signal from the first signal;

a second antenna operable to receive the second signal;

a position detector operable to detect the position information from the second signal;

an emergency input unit for use by an operator of said mobile communication terminal to make an entry in an emergency;

a storage unit operable to store contact information including emergency contact information; and a controller operable to control operation of said mobile communication terminal;

wherein said controller, when the operator has made a predetermined entry into said emergency input unit:

allows the emergency contact information to be retrieved from said storage unit;

allows said converter unit to generate a first signal from the emergency contact information to be transmitted from said first antenna;

allows a communication to be established after said first antenna has received a response signal from a party on the other end of the communication connection; and allows said converter unit to convert the position information obtained by said position detector unit into the first signal so as to be transmitted from said first antenna.

14. The mobile communication terminal according to claim 13, wherein said second antenna is positioned to be less than 0.35×L from a top face of said case, where L denotes a height of said case.

15. The mobile communication terminal according to claim 13, further comprising a speaker contained in an upper portion of said case; and wherein said second antenna is contained in said case such that said second antenna confronts a back side of said speaker.

16. The mobile communication terminal according to claim 13, further comprising a speaker juxtaposed with said second antenna.

17. The mobile communication terminal according to claim 13, wherein said second antenna is contained in said case such that a top face of said case is arranged to be parallel and opposite to a principal face of said second antenna.

18. The mobile communication terminal according to claim 13, further comprising a display unit operable to display information to be read by the operator.

* * * * *